United States Patent [19]

Berry

[11] Patent Number: 4,673,516

[45] Date of Patent: Jun. 16, 1987

[54] AQUEOUS HYDROGEL LUBRICANT

[75] Inventor: Johnny D. Berry, Duncanville, Tex.

[73] Assignee: Integral Corporation, Dallas, Tex.

[21] Appl. No.: 902,514

[22] Filed: Sep. 2, 1986

[51] Int. Cl.[4] ..... C10M 173/02; C10M 145/40

[52] U.S. Cl. ..... 252/49.5; 252/42.1; 252/49.3; 252/49.6

[58] Field of Search ..... 252/49.5, 42.1, 49.3

[56] References Cited

U.S. PATENT DOCUMENTS

| | | | |
|---|---|---|---|
| 3,526,596 | 9/1970 | Kress et al. | 252/49.5 |
| 4,111,820 | 9/1978 | Conti | 252/49.5 |
| 4,162,347 | 7/1979 | Montgomery | 428/474.4 |
| 4,290,810 | 9/1981 | Montgomery | 106/3 |
| 4,359,340 | 11/1982 | Comper et al. | 252/49.5 |
| 4,378,299 | 3/1983 | Alexander | 252/49.3 |

*Primary Examiner*—William R. Dixon, Jr.
*Assistant Examiner*—Ellen M. McAvoy
*Attorney, Agent, or Firm*—Kenneth R. Glaser

[57] ABSTRACT

Disclosed is an aqueous gel lubricant, and a method for formulating the lubricant, the lubricant having, as its basic and essential components, a major proportion of water, an effective gelling amount of an anionic heteropolysaccharide, and an effective lubricating amount of an anionic emulsion of a polysiloxane polymer. Additions of effective lubricating amounts of suspended microspherical beads enhance the lubricity and a suitable anti-freeze agent enhances the lubricant's effectiveness for low temperature applications. The lubricant is particularly adapted to facilitate the installation of cables within outer ducts or conduits.

8 Claims, No Drawings

AQUEOUS HYDROGEL LUBRICANT

This invention relates to lubricants, more particularly to aqueous gel lubricants, and even more particularly to aqueous hydrogel compositions for particular use for the installation of power and communication cables within conduits.

There are many applications where an effective lubricant is required in order to facilitate the movement of one member with respect to another. For example, and of particular importance to the use of the lubricant of the present invention, power and communication networks of times require the rapid and efficient installation of the power or communication cables through many miles of outer ducts or conduits, many of which being underground. To meet the demand for rapid installations of these cables, which may require installation velocities approaching 300 feet per minute, it is necessary to provide an effective lubricant at the interface of the outside surface of the cable and the inside surface of the outer duct which sufficiently reduces the coefficient of friction between the surfaces.

While various lubricants have been developed for this purpose, they have not been entirely satisfactory for all conditions of service. For example, many of the available aqueous lubricants exhibit too low a viscosity to effectively reduce the frictional forces between the cable and the outer conduit, while many of the visto-elastic gel type lubricants exhibit such a high working viscosity that they effectively increase the coefficient of dynamic friction due to the forces necessary to overcome the viscosity of the lubricant. Furthermore, and many times of even greater importance, is the fact that many of the existing lubricants exhibit viscosity instability over the wide temperature ranges to which the cable installations are often subjected, as well as viscosity instability in the presence of cationic metal ions and other contaminants which exist in underground installations, thereby having an adverse effect on the net performance of the lubricants.

One approach which has been used in an attempt to reduce the friction between the outer surface of the cable jacket and the inner surface of the outer conduit is the use of small, generally spherical polymer beads suspended within a fluid medium, these microspheres thereby essentially functioning as anti-friction ball bearings between the respective cable and conduit surfaces. While this approach generally has merit, existing lubricants of this type are presently ineffective due to deficiencies in the supporting fluid in which the microspheres are suspended, and in particular to the inability of existing suspension fluids to maintain the proper distribution and location of these microspheres within the fluid medium when the lubricant is subjected to the widely varying, naturally occurring environmental temperature fluctuations.

It is therefore a principal object of the present invention to provide a new and improved lubricant, particularly one adapted to more effectively reduce the static and dynamic coefficient of friction between the outer surface of a cable and the inner surface of a conduit through which the cable is moved.

It is a further object of the present invention to provide a new and improved aqueous gel lubricant of stable viscosity and capable of being used in environments of wide temperature swings and sub-freezing conditions, and capable of being effectively applied and used in connection with cable installations.

It is a still further object of the invention to provide a new and improved aqueous gel lubricant in which microspherical beads can be more effectively suspended and distributed through the hydrogel.

In accordance with these and other objects, the present invention is directed to an aqueous gel lubricant comprising, as its basic and essential components, a major proportion of water, an effective gelling amount of an anionic heteropolysaccharide, and an effective lubricating amount of an anionic emulsion of a polysiloxane polymer. Due to these constituents, the resulting advantageous lubricant is pseudoplastic, thixotropic, shear sensitive, and viscosity stable.

In accordance with a particular feature of the invention, the aforementioned aqueous gel lubricant may also include an effective lubricating amount of anti-friction microspherical beads suspended therein to enhance the lubricity of the total composition. In addition, a suitable antifreeze agent may be included in the overall composition to reduce the freezing point of the lubricant, thereby making the lubricant more effective for low temperature applications.

Specific and additional features of the invention, as well as additional objects and advantages thereof, will become readily apparent from the following detailed description of preferred forms of the inventive lubricant.

Anionic Heteropolysaccharide Component

A principal component of the aqueous gel lubricant of the present invention is an anionic heteropolysaccharide compound. The principal purpose of this compound is to provide a gelling substance having pseudoplastic and thioxotropic properties.

A preferred form of the anionic heteropolysaccharide is a carbohydrate having 2.8–7.5% o-Acyl groups; 11.6–14.9% glucoronic acid, and neutral sugars mannose, glucose and rhamnose in an approximate molar ratio of 1:2:2. The ratio of terminally linked rhamnose to 1,4 linked rhamnose is 1:2; and the glucose is principally 1,3 linked, with the glucuronic acid portion of the polysaccharide preferably being neutralized to potassium salts. The heteropolysaccharide is desirably produced by a fermentation process in the presence of a desired Alcaligenes species; and the polysaccharide is principally straight chained.

The resulting heteropolysaccharide imparts the desired viscosity to the overall aqueous gel lubricant when dissolved in water at very low concentrations, the water constituting the major portion of the total composition. In addition, the anionic nature of the heteropolysaccharide plays an important role in the hydrogel being viscosity stable from its freezing point to its boiling point, from a pH range of 2 through 12, and in the presence of salt ion concentrations up to 15% by weight.

Anionic Emulsion of Polysiloxane Polymer Component

A second principal component of the composition of the present invention is an effective lubricating amount of an anionic emulsion of a polysiloxane polymer, preferably polydimethylsiloxane, which essentially provides the principal lubricant of the composition.

By utilizing an emulsion which is similar in chemical likeness to the anionic polysaccharide, chemical compatability is enhanced. A preferred emulsion is one of a high polymer of siloxane, preferably of a molecular weight greater than 4000, and of a viscosity from 60,000 cps to 1,000,000 cps, these viscosities having been shown to provide superior lubricity. In addition, these type polymers are hydrophobic in nature, making the surface of the cable jackets and conduits water resistant, while at the same time providing excellent lubricity. These polymer emulsions furthermore exhibit low toxicity and do not degenerate the service life of the cable jackets or conduits.

Anti-Friction Microspherical Beads Component

The aqueous hydrogel composition, as previously described, in and of itself provides a superior lubricant. In addition, however, it may be desired to incorporate therewith an additional effective lubricating amount of antifriction microspherical beads suspended within the hydrogel. Accordingly, the anti-friction microspheres or "beads" may preferably be formed of a polydivinyl benzene, polycinnamene, polyacrylate, polyfloracarbon, or polyalkane composition, or of many other alternative hydrocarbon polymer compositions which effectively impart to the spherical beads anti-friction ball bearing characteristics. It is preferred that the size of the microspheres be between 0.020 and 0.035 inches in diameter with screen sieving being used, for example, to obtain the desired size spheres. An effective lubricating quantity of the microspheres may then be added to the hydrogel composition of the water, anionic heteropolysaccharide, and polysiloxane polymer emulsion, the hydrogel composition acting as an effective suspension medium for the microspheres.

If desired, hydroxyl bearing compounds which are soluble in water can be used to lower the freezing point temperature of the aqueous gel lubricant of the invention. Examples of these compounds are simple low molecular weight alcohols, such as methanol; simple glycols, such as ethylene or propylene glycol; and higher polymer glycols, such as polyethylene or polypropylene glycols. These materials may be straight or branched chained monomers, or alternatively straight or branched chain high polymers. Thus, examples of suitable anti-freeze additives would be methanol, ethanol, propanol, isopropanol, butanol, isobutanol ethylene glycol, diethylene glycol, propylene glycol, polyethylene glycols, and polypropylene glycols with the preferred anti-freeze additives being ethylene glycol, propylene glycol, polyethylene glycol, and polypropylene glycol.

Formulation of Lubricant

As described, the lubricant of the invention is an aqueous hydrogel substance composed of a major portion of water, an anionic heteropolysaccharide, and an anionic emulsion of a polysiloxane polymer, with the anti-friction microspherical beads being suspended, if desired, within the hydrogel. If required, a suitable amount of freeze point depressing anti-freeze agents may also be included.

A preferred method of forming the lubricant so as to result in a uniform stable suspension is as follows:

Water is first introduced into a suitable vessel, the level of water bring sufficient to displace approximately one-half to two-thirds of the volume of the mixing container. The water should then be agitated, for example by a single blade high shear type mixer, to cause the water to vortex, with the mixing blade being positioned slightly off center to the mixing container in order to produce maximum turbulance at the lower portion of the vortex. It is preferable that the agitator blade be submerged to prevent excessive aeration.

Next, 0.05 to 3.0 parts by weight of the heteropolysaccharide are slowly sifted into the bank of the vortex. Sufficient time should be allowed for the heteropolysaccharide to become surface wet in a finely divided state since gross additions of the heteropolysaccharide will cause clumping of the polymer, and solvation will become long and tedious. Once solvation starts occurring, it will take place rapidly and the viscosity of the mixture will rapidly increase. The anionic emulsion of the polysiloxane polymer is then added during the mixing operation. An effective lubricating amount of polysiloxane emulsion will be from 5 to 25 parts by weight of the intended batch size with the addition time of the emulsion having no significant effect on the finished product.

Next, if desired, anti-friction beads are sifted into the vortex in a manner which desirably prevents clumping of the beads. The anti-friction beads should comprise 1% to 10% by weight of the final lubricant blend, with a preferred concentration being 3% to 7% by weight.

If a low freeze point product is desired, the water must be replaced by the anti-freeze composition in concentrations up to 50% by weight. The anti-freeze composition should desirably be added after the polysaccharide has been completely dissolved.

Finally, to prevent microbial attack of the polysaccharide, a suitable biocide should be added. Concentrations of these materials may range from 0.01% to 1.0% by weight, with the preferred range being 0.1% to 0.5%. Formaldehyde may be used as a preservative although less toxic complexes are also available.

The following are examples of formulations of the aqueous gel lubricant of the present invention:

FORMULATION EXAMPLE I

Into a 2 liter high speed blender was charged 480 grams of water at ambient temperature. 8.2 grams of an anionic heteropolysaccharide, as previously described, was weighted out to the nearest 0.1 gram. The blender was turned on to its lowest speed and the heteropolysaccharide sifted in slowly. Care was taken to prevent agglomerates from entering the mixing water. The polysaccharide entered the mixer in a finely divided state, and a rapid build in viscosity after completion of addition of the polysaccharide was noted. A measured emulsion of 80 grams of polydimethylsiloxane was added to the mixture while under shear; and care was taken to prevent polysaccharide polymer breakdown due to excessive shear. Next, 30 grams of anti-friction microspheres, also in a finely divided state, were added to the mixture followed by the final addition of 0.6 grams of Dowcil 75 biocide, a product of Dow Chemical Company. All ingredients were homogeneously mixed.

An off-white thixotropic, pseudoplastic, shear sensitive lubricant was obtained. Using a Brookfield instrument with a #4 spindle at 70° F., the viscosity at 50 RPM was measured at 2,100 cps; and at 100 RPM, the viscosity was measured at 1,200 cps.

FORMULATION EXAMPLE II

Into a 2 liter high speed blender was charged 336 grams of water at ambient temperature. 8.2 grams of the novel heteropolysaccharide was weighted to the nearest 0.1 gram and sifted into a blender while under shear. The mixture built to a much higher viscosity than Formulation Example I due to a higher concentration of the polysaccharide. Next, 80 grams of the polysiloxane emulsion was added immediately after the addition of the polysaccharide was completed in order to reduce the viscosity of the mixture. Next, 144 grams of propylene glycol was added, after which a marked reduction in viscosity was observed due to the dilution of the polysaccharide. Again, 30 grams of anti-friction microspheres were added to the mixture followed by 0.6 grams of Dowicil 75 biocide. This mixture yielded a light tan thixotropic, pseudoplastic, shear sensitive, low friction point lubricant. Friction testing revealed coefficient of friction values as much as 50% lower than water based lubricants intended for like use.

The aqueous gel lubricant of the present invention exhibits advantageous properties and characteristics making it far superior for use in cable/conduit installations. For example, the lubricant, in addition to being pseudoplastic, thixotropic, and extremely shear sensitive, exhibits stable viscosity over wide temperature ranges, fluctuations in pH, and in the presence of environmental contaminants. Furthermore, the lubricant, exhibiting superior lubricating properties, is extremely flowable and pumpable. This facilitates its application to the outside surface of the cable and to the internal surface of the outer conduit, as well as at their interface, to substantially reduce the static and dynamic coefficient of friction between these surfaces during the insertion (and pulling) of cable through the conduits and outer ducts.

In addition, when the anti-friction microspherical beads are incorporated with the basic hydrogel, the rheological properties of the gel more effectively maintain these microspheres in proper distribution and location through the suspension medium, thereby providing an even more effective lubricant for insertion between the outer cable jackets and the conduit through which the cable is inserted or pulled.

Various modifications to the disclosed embodiments of the aqueous gel lubricant of the present invention, as well as alternate embodiments thereof, may become apparent to persons skilled in the art without departing from the spirit and scope of the invention as solely defined by the appended claims.

What is claimed is:

1. An aqueous gel lubricant, comprising:

(a) a major proportion of water;

(b) an effective gelling amount of an anionic heteropolysaccharide; and (c) an effective lubricating amount of an anionic emulsion of a polysiloxane polymer.

2. The aqueous gel lubricant as set out in claim 1 further comprising an effective lubricating amount of anti-friction microspherical beads.

3. The aqueous gel lubricant as set out in claim 2 further comprising an anti-freeze composition.

4. The aqueous gel lubricant as set out in claim 1 wherein said anionic heteropolysaccharide is a carbohydrate comprising 2.8–7.5% o-Acyl groups; 11.6–14.9% glucoronic acid, and neutral sugars mannose, glucose and rhamnose in an approximate molar ratio of 1:2:2.

5. The aqueous gel lubricant as set out in claim 4 wherein said polysiloxane polymer is polydimethylsiloxane.

6. The aqueous gel lubricant as set out in claim 4 wherein the molecular weight of the polysiloxane polymer is greater than 4000.

7. The aqueous gel lubricant as set out in claim 2 wherein said anti-friction microspherical beads are of a material selected from the group consisting of polydivinyl benzene, polycinnamene, polyacrylate, polyflurocarbon, and polyalkane composition.

8. A method for reducing the coefficient of friction between a cable and an outer conduit through which the cable is pulled, comprising:

preparing an aqueous gel lubricant of a major proportion of water, an effective gelling amount of an anionic heteropolysaccharide, and an effective lubricating amount of an anionic emulsion of a polysiloxane polymer; and applying said aqueous gel lubricant at the interface of the outside surface of said cable and the internal surface of said outer conduit.

* * * * *